United States Patent [19]

Guscott et al.

[11] Patent Number: 4,546,344

[45] Date of Patent: Oct. 8, 1985

[54] TEMPERATURE COMPENSATED ALARM SYSTEM

[75] Inventors: John K. Guscott, Lynnfield; Mario Casamassima, Randolph, both of Mass.

[73] Assignee: American District Telegraph Company, New York, N.Y.

[21] Appl. No.: 586,104

[22] Filed: Mar. 5, 1984

[51] Int. Cl.[4] ..... G08B 23/00

[52] U.S. Cl. ..... 340/501; 340/511; 340/522; 340/565; 374/132

[58] Field of Search ..... 340/501, 510, 511, 517, 340/518, 521, 522, 555, 565, 588, 589; 374/132, 133, 172

[56] References Cited

U.S. PATENT DOCUMENTS 4,364,030 12/1982 Rossin ..... 340/565

4,475,103 10/1984 Brokaw et al. ..... 340/501

*Primary Examiner*—Donnie L. Crosland

*Attorney, Agent, or Firm*—Weingarten, Schurgin, Gagnebin & Hayes

[57] ABSTRACT

A temperature compensated alarm system includes a temperature transducer operative to produce an electrical output signal indicative of the ambient temperature, an alarm sensor, an electronic processing module, and a plurality of addressable registers for storing alarm threshold limits applicable at the operative ambient temperature. At selected times the electronic processing module reads a value indicative of the ambient temperature and thereupon determines the applicable alarm threshold limits by addressing the respective registers containing threshold limit data for the particular ambient temperature. In one embodiment, two sets of registers are provided; one set of registers containing higher sensitivity threshold limit data and the second set containing lower sensitivity threshold limit data. The applicable threshold data is determined by the state of a user settable switch.

11 Claims, 3 Drawing Figures

TEMPERATURE COMPENSATED ALARM SYSTEM

FIELD OF THE INVENTION

This invention relates to alarm systems and more specifically to a novel temperature compensated alarm system.

BACKGROUND OF THE INVENTION

Passive infrared detectors receive infrared energy from a zone of interest and produce an electrical signal representative of the differential temperature between the background ambient temperature and the temperature of a moving object or target. In one common application, passive infrared detectors are employed in security systems as intrusion detectors. In such applications, the electrical output signal from the passive infrared detector is compared against predetermined threshold limits and if the signal is outside the limits an alarm indication is provided.

The object temperature of a typical clothed human target is approximately 85° F. Since a passive infrared detector senses variations in received infrared energy it is more difficult to detect a human target at 85° F. then above or below this temperature. Accordingly, to achieve reliable detection of targets at 85° F. or thereabouts it is desirable that a passive infrared detection system have a greater sensitivity at this temperature. One passive infrared detector known in the art and available as a product from the assignee of the present invention incorporates single slope temperature compensation. While such compensation provides improved immunity from false alarms at temperatures below 85° F., single slope compensation provides no benefit above this temperature.

SUMMARY OF THE INVENTION

In accordance with the invention, a temperature compensated alarm system is disclosed. One embodiment of the invention includes a passive infrared sensor, a temperature transducer, a plurality of data storage registers an an electronic processing module.

The passive infrared sensor provides a first analog output signal in response to received infrared energy. The analog output signal from the infrared sensor is applied to a first analog to digital converter to produce a digital signal representative of the passive infrared sensor output. The temperature transducer provides a second analog output signal representative of the ambient temperature. The second signal is applied to a second analog to digital converter to produce a digital signal indicative of the ambient temperature. The digital signals from the first and second analog converters are selectively readable by the electronic processing module.

The data registers are selectively addressable by the processing module and contain data represetative of upper and lower alarm threshold limits for a range of operative ambient temperatures. The alarm threshold limit values are selected such that the alarm limits are narrower with respect to the nominal passive infrared sensor output voltage at 85° F. than above or below this temperature. Accordingly, the sensitivity of the passive infrared detector is highest at 85° F. to maximize the probability of target detection and the sensitivity of the detector falls off above and below 85° F. to minimize the probability of false alarms.

In operation, the processing module samples the digital outputs representative of the temperature transducer and passive infrared sensor outputs respectively. The processing module thereupon accesses selected ones of the storage registers containing threshold limit data applicable at the particular ambient temperature. The digital signal representative of the passive infrared sensor output signal is compared against the respective threshold limits by the electronic processing module. If the module determines that the infrared sensor digital signal is greater than the upper alarm threshold or below the lower alarm threshold and thereby exceeds the respective threshold an alarm signal is generated.

In one embodiment of the invention two sets of data registers are provided. One set of registers contains data representing narrow alarm thresholds and the second set of registers contains data representing wider alarm thresholds. A switch is provided and is settable by a user to indicate which set of registers is accessed by the processing module in determining the applicable alarm threshold limits.

It is apparent that any practical number of sets of registers may be provided to allow for a greater number of user selectable system sensitivities.

BRIEF DESCRIPTION OF THE DRAWINGS

The invention will be fully understood by reference to the following detailed description in conjunction with the accompanying drawings of which.

DETAILED DESCRIPTION OF THE INVENTION

Figure 1:
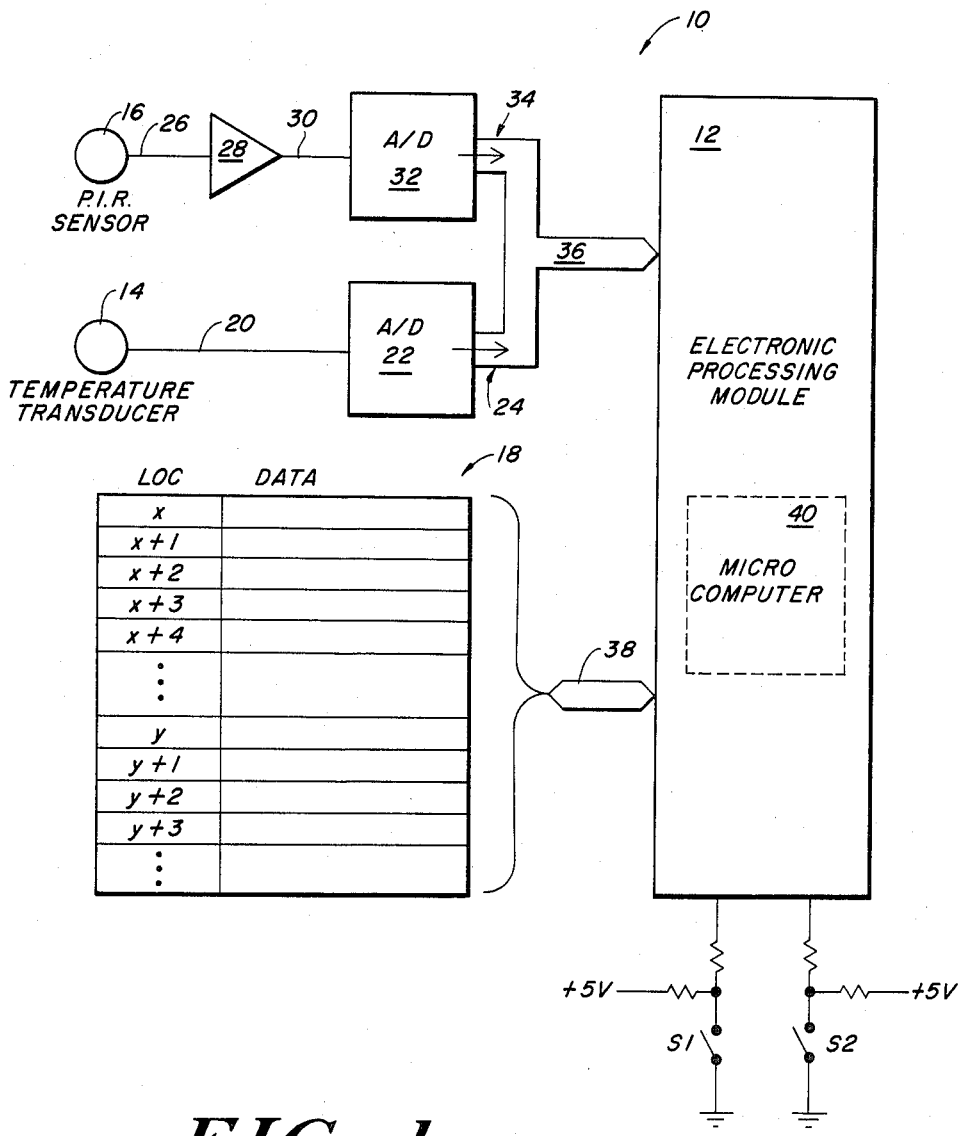
FIG. 1 is a block diagram of a temperature compensated passive infrared detector in accordance with the present invention.

Referring to FIG. 1, a block diagram of an alarm system comprising a temperature compensated passive infrared detector generally designated at 10 is disclosed. The system includes an electronic processing module 12, a temperature transducer 14, a passive infrared sensor 16 and a plurality of selectively addressable registers 18 adapted for storage of digital data.

In accordance with the present invention, the temperature transducer 14 is operative to provide an analog output signal 20 indicative of the ambient temperature. In one embodiment of the invention a National Semiconductor model LM-335 linear temperature sensor was employed successfully although any suitable sensor which provides an electrical output signal representative of ambient temperature may be substituted therefor. The analog output signal 20 from the temperature transducer 14 is applied to an analog to digital converter 22 which produces a digital output signal 24 representative of the amplitude of the transducer analog signal 20.

The passive infrared sensor 16 is a sensor of a type well known in the art. The sensor provides an analog output signal 26 in response to receive infrared energy as occassioned for example by the motion of a human target through the field of view of the sensor 16. The sensor analog output signal 26 is applied to an amplifier 28 which buffers and amplifies the signal 26. The amplifier 28 produces an output signal 30 which is applied to a second analog to digital converter 32. The analog to digital converter 32 is operative to provide a digital signal 34 representative of the passive infrared sensor 16 output signal 26. Digital signals 24 and 34 representative of the temperature transducer 14 analog output signal 20 and the passive infrared sensor 16 analog output signal 26 and may be accessed by the processing module 12 via data lines 36. The analog to digital converters 22 and 32 may comprise separate converters or may comprise a single converter having multiplexed inputs. One such analog to digital converter is part no. ADCO834 available from National Semiconductor Corporation.

The data registers 18 are selectively addressable by the processing module 12 to retrieve data from the respective registers over a data bus 38. The registers 18 contain data from the representive of upper and lower alarm threshold limits applicable at specific ambient temperatures. For example, if the upper threshold limit at 0° F. was defined to be 2.35 volts and the lower threshold limit at 0° F. was defined to be .95 volts, two of the registers 18 would contain digital data representative of these respective upper and lower threshold values. Similarly, if the upper threshold limit at 85° F. was defined to be 1.95 volts and the lower threshold limit at 85° F. was defined to be 1.35 volts, two of the registers 18 would contain digital data representative of these respective threshold values. It is noted that the exemplary threshold values correspond to upper and lower high sensitivity threshold limits shown in FIG. 2.

In a preferred embodiment of the invention, the processing module 12 includes a microcomputer 40 such as a uPD80C48 microcomputer available from Nippon Electric Corporation. The uPD80C48 microcomputer is a CMOS single chip 8 bit microcomputer including 1 kilobyte of read only memory, and 64 bytes of random access memory. The storage registers 18 may comprise selected read only memory locations of the uPD80C48 microcomputer, external read only memory, external random access memory or any other suitable set of register accessible by the processing module 12.

Figure 3:
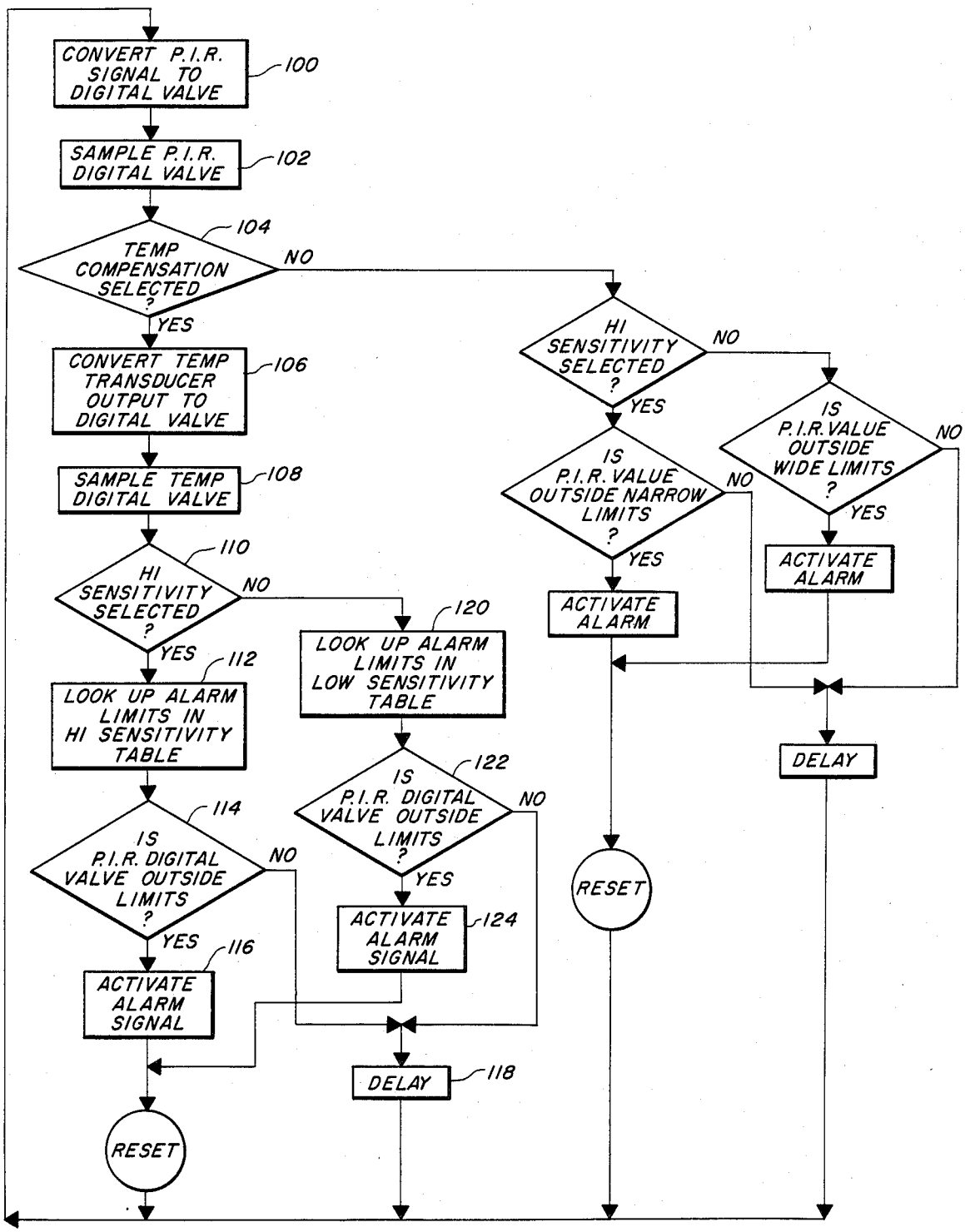
FIG. 3 is a flow chart illustrating operation of a temperature compensated passive infrared detector in accordance with the present invention.

Operation in accordance with the present invention will be further appreciated by reference to the process diagram of FIG. 3.

As illustrated in step 100, the passive infrared sensor output signal is converted to a digital signal at selected times by an analog to digital converter 32. In accordance with step 102, the processing module 12 accesses the digital signal 34 representative of the passive infrared sensor 16 output signal 26 at selected sampling times. In a decision step 104 the state of a user settable switch S1, illustrated in FIG. 1, is tested to ascertain if the temperature compensation mode of alarm system operation is selected. If the temperature compensation mode is selected, the temperature transducer 14 output signal 20 is converted to a digital signal 24 by an analog to digital converter 22 as shown in step 106. In accordance with step 108 the digital signal 24 representative of the ambient temperature is sampled by the processing module 12. In a decision step 110, the state of a user settable switch S2, illustrated in FIG. 1, is tested to ascertain if the operational sensitivity is set for high or low sensitivity corresponding to exemplary curves depicted in FIG. 2.

If switch S2 is set for the high sensitivity operational mode, in accordance with step 112, the applicable upper and lower threshold limits are read from the respective storage registers 18 corresponding to registers X, X+1, X+2 . . . for the particular ambient temperature ascertained in step 108. As set forth in decision step 114, if the digital value representative of the passive infrared sensor 16 output and determined in accordance with step 102, is above the upper threshold limit or below the lower threshold limit, an alarm signal generated, as set forth in step 116. If the digital value representative of the passive infrared sensor 16 output is within the respective limits, no alarm signal is generated, and, in accord with step 118, a specified delay is provided by processing module 12 prior to repetition of the sequence commencing with step 100.

Figure 2:
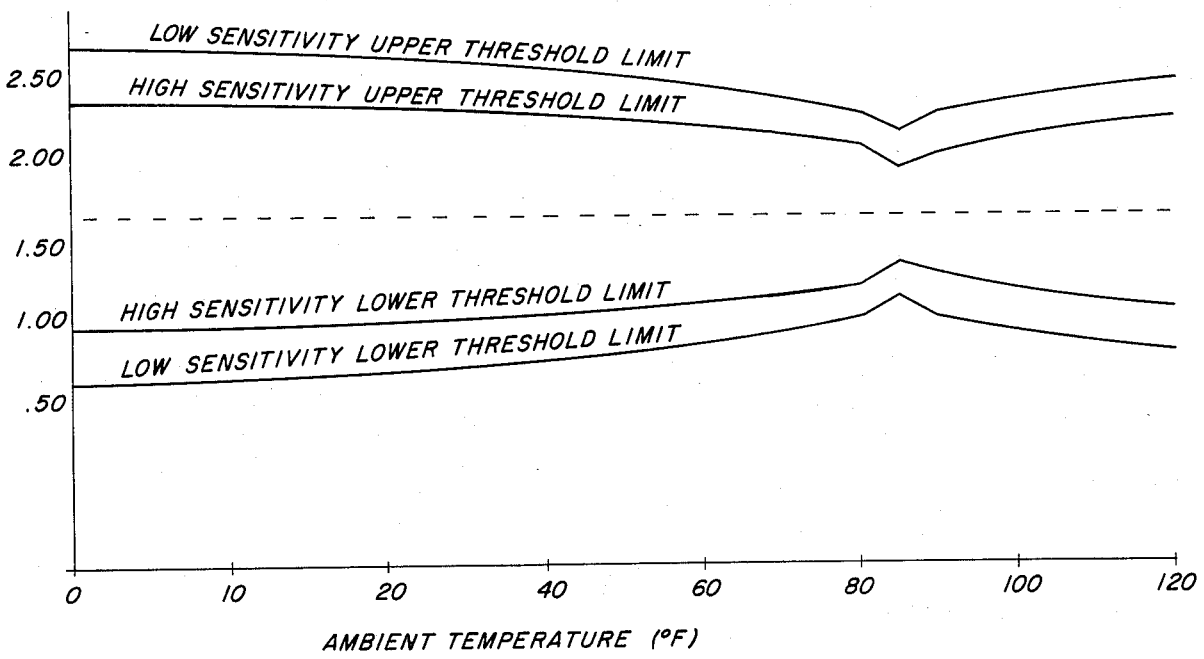
FIG. 2 is an exemplary graph showing threshold limits as a function of ambient temperature for higher sensitivity and lower sensitivity conditions.

If, in decision step 110, the user settable switch S2 is tested and the low sensitivity operational mode is selected, a second set of storage registers 18 corresponding to registers Y, Y+1, Y+2 . . . is accessed as set forth in step 120. The second set of storage registers 18 contain data with wider threshold limits than contained in the registers holding high sensitive threshold data as illustrated in FIG. 2. In decision step 122, it is determined if the value representative of the sensor 16 output exceeds one of the low sensitivity threshold limits, corresponding to data accessed from the selected registers. If the sensor 16 output exceeds one of the low sensitivity threshold limits an alarm signal is generated as indicated in step 124. If the digital value representative of the sensor 16 output is within the respective limits, no alarm signal is generated and, a delay is provided in accordance with step 118 prior to repetition of this process.

It is apparent that any practical number of sets of storage registers may be provided to permit user selection of different operational alarm sensitivities.

The above described invention is illustrative of a method and apparatus for providing temperature compensation in an alarm system employing a passive infrared detector. Other embodiments, modifications and departures from the present disclosure are possible including but not limited to the use of other alarm system sensors without departing from the inventive concepts contained herein. Consequently, the invention is to be viewed as embracing each and every novel feature and novel combination of features present in or possessed by the invention herein disclosed, and is to be limited solely by the scope and spirit of the appended claims.

What is claimed is:

1. A temperature compensated alarm system comprising:

an alarm sensor having a known temperature characteristic and operative to produce an electrical output signal representative of a desired parameter to be monitored;

a temperature transducer operative to provide an electrical output signal representative of the ambient temperature in vicinity of the transducer;

a plurality of selectively addressable storage registers containing data representative of alarm threshold limits applicable at specified ambient temperatures;

an electronic processing module including:

means for sampling said alarm sensor and temperature transducer output signals;

means for addressing and accessing threshold data from at least one selected register of said plurality in response to said transducer output signal; and means for generating an alarm signal if said sensor output signal exceeds said threshold data from said at least one selected register.

2. The alarm system of claim 1 including:

a converter operative to produce a digital output signal representative of said alarm sensor electrical output signal;

a converter operative to produce a digital output signal representative of said temperature transducer electrical output signal.

3. The alarm system of claim 2 wherein said alarm sensor is operative to produce an analog output signal having an amplitude which varies responsive to a specified parameter to be monitored, said temperature transducer is operative to produce an analog output signal representative of the ambient temperature, said converter for producing a digital signal representative of said alarm sensor electrical output signal includes an analog to digital converter operative to produce a digital signal representative of said alarm sensor analog output signal; and said converter for producing a digital signal representative of said temperature transducer output signal includes an analog to digital converter operative to produce a digital signal representative of said temperature transducer analog output signal.

4. The alarm system of claim 3 wherein said means for sampling said alarm sensor and temperature transducer output signals includes means for sampling said digital signal representative of said alarm sensor output signal and said digital signal representative of said temperature transducer output signal respectively.

5. The alarm system of claim 1 wherein selected ones of said plurality of registers contains data representative of upper threshold limits and other selected ones of said plurality of registers contain data representative of lower threshold limits.

6. The alarm system of claim 1 wherein said electronic processing module includes a microcomputer.

7. The alarm system of claim 6 wherein said plurality of storage registers comprises selected registers internal to said microcomputer.

8. The alarm system of claim 7 wherein said selected registers internal to said microcomputer comprise selected read only memory registers.

9. A method for providing temperature compensation in an alarm system comprising the steps of:

producing a first electrical signal having a characteristic representative of ambient temperature;

producing a second electrical signal representative of a specified parameter to be monitored;

selectively addressing at least one digital storage register containing data representative of alarm threshold limits based upon said first electrical signal characteristic representative of ambient temperature;

accessing said threshold limit data contained in said at least one digital storage register; and generating an alarm signal if said second electrical signal has a value exceeding said threshold limit data.

10. The method recited in accordance with claim 9 wherein said first electrical signal producing step includes the steps of:

providing a temperature transducer operative to produce an output signal representative of ambient temperature;

applying the temperature transducer output signal to a converter operative to produce a digital signal representative of said transducer output signal; and said addressing step includes the step of selectively addressing at least one digital storage register containing threshold limit data based upon the value of said digital signal representative of said temperature transducer output signal.

11. The method recited in accordance with claim 9 wherein said second electrical signal producing step includes the steps of:

providing an alarm sensor operative to produce an electrical output signal representative of a condition to be monitored;

applying the alarm sensor output signal to a converter operative to produce a digital signal representative of said alarm sensor output signal; and said generating step includes the step of generating an alarm signal if the digital signal representative of said alarm sensor output signal has a value exceeding said threshold limit data.

* * * * *